US005152156A

United States Patent [19]

Tokairin

[11] Patent Number: 5,152,156

[45] Date of Patent: Oct. 6, 1992

[54] ROTARY COMPRESSOR HAVING A PLURALITY OF CYLINDER CHAMBERS PARTITIONED BY INTERMEDIATE PARTITION PLATE

[75] Inventor: Masatsugu Tokairin, Shizuoka, Japan

[73] Assignee: Kabushiki Kaisha Toshiba, Kawasaki, Japan

[21] Appl. No.: 785,006

[22] Filed: Oct. 30, 1991

[30] Foreign Application Priority Data

Oct. 31, 1990 [JP] Japan ..... 2-291736

[51] Int. Cl.[5] ..... F04C 29/08

[52] U.S. Cl. ..... 62/498; 418/60; 418/212; 417/286

[58] Field of Search ..... 62/498; 418/60, 212; 417/286, 426

[56] References Cited

U.S. PATENT DOCUMENTS 4,452,570 6/1984 Fujisaki ..... 417/286
4,726,739 2/1988 Saitou ..... 418/60 X
4,826,408 5/1989 Inoue ..... 418/60

FOREIGN PATENT DOCUMENTS 62-70686 4/1987 Japan .
62-225794 10/1987 Japan .
2-25037 5/1990 Japan .

*Primary Examiner*—Alan Cohan
*Attorney, Agent, or Firm*—Cushman, Darby & Cushman

[57] ABSTRACT

An intermediate partition plate is provided between a plurality of adjacent cylinders to partition cylinder chambers in the cylinders from each other. A guide opening portion, in which respective cylinder abutting surfaces are open, is formed in the intermediate partition plate at a position on an outer side than a cylinder circumferential surface, and a slider is housed to be reciprocated. Gas is guided from the cylinder chambers during compression to the guide opening portion through first and second notches to apply the pressures of the cylinder chambers to the slider. A back pressure is applied to the slider from a back pressure pipe to move forward or backward the slider by a difference pressure between the back pressure and the cylinder chamber pressures. The slider shuts off the cylinder chambers from each other or escapes from the first and second notches to cause the cyliner chambers to communicate with each other through the first and second notches and the guide opening portion.

14 Claims, 6 Drawing Sheets

ROTARY COMPRESSOR HAVING A PLURALITY OF CYLINDER CHAMBERS PARTITIONED BY INTERMEDIATE PARTITION PLATE

BACKGROUND OF THE INVENTION

1. Field of the Invention

The present invention relates to a compressor, constituting a refrigeration cycle circuit in a refrigerating apparatus, which is a rotary compressor having a plurality of cylinder chambers partitioned by an intermediate partition plate.

2. Description of the Related Art

In a refrigerating apparatus, a multi-cylinder type rotary compressor is used as a compressor constituting the refrigeration cycle circuit.

The multi-cylinder type rotary compressor has a plurality of cylinders partitioned by an intermediate partition plate in the axial direction of the rotating shaft.

A roller is fitted on an eccentric portion mounted on the rotating shaft. When the rotating shaft is rotated, the roller is driven, eccentrically rotating along the inner circumferential surface of the cylinder chamber.

A vane biased by a spring contacts the outer circumferential surface of the roller and divides the cylinder chamber into high- and low-pressure chambers.

The refrigerant gas is drawn by vacuum into the low-pressure chamber. As the roller is eccentrically pivoted, the refrigerant gas is compressed as it is transferred to the high-pressure chamber, and is discharged when its pressure is increased to a predetermined high pressure.

In such a multi-cylinder type compressor, the plurality of independent cylinder chambers perform compression. Therefore, when compared with a conventional rotary compressor having only one cylinder chamber, the refrigerating capability is improved.

However, the refrigerating capability is always constant and cannot be changed in accordance with a load.

Published Unexamined Japanese Patent Application Nos. 62-225794 and 62-70686 and Published Examined Japanese Patent Application No. 2-25037 disclose inventions that can eliminate inconvenience of this type.

According to Published Unexamined Japanese Patent Application No. 62-225794, release paths for returning part of the gas being compressed to the suction side are connected to two cylinders.

Capacity control valves are provided to these release paths in order to control the compression capacities of the respective cylinders.

The release paths are merged after passing through the capacity control valves.

According to Published Unexamined Japanese Patent Application No. 62-70686, a plurality of cylinder chambers are partitioned by an intermediate partition plate.

These cylinder chambers communicate with each other through a path. This path is opened/closed by a valve unit.

The path is formed in the intermediate partition plate. The valve unit is operated by a back pressure or is driven by a solenoid valve.

According to Published Examined Japanese Patent Application No. 2-25037, a high-pressure chamber of one of adjacent cylinders and a low-pressure chamber of the other of the adjacent cylinders communicate with each other through a path formed in an intermediate partition plate.

An opening/closing mechanism is provided for closing and opening the path in the normal operation and in the decreased capability operation, respectively.

In any of the disclosed techniques, an opening/closing mechanism such as a valve is operated to open or close the path, so that the refrigerating capability can be variably controlled in accordance with a load.

The release paths of Published Unexamined Japanese Patent Application No. 62-225794 are formed to extend from the outer circumferential surfaces of the respective cylinders to the inner circumferential surface of the intermediate partition plate along the thicknesses of the cylinders and the intermediate partition plate.

The capacity control valves are provided midway along the release paths provided to the respective cylinders.

Therefore, both the cylinders and the intermediate partition plate must be subjected to necessary working, resulting in cumbersome working.

Since the release paths must accurately communicate with each other from the cylinders to the intermediate partition plate, high-precision working and assembly are required.

The number of the capacity control valves must corresponds to that of the cylinders, resulting in a large number of components. As the capacity control valves are located midway in the release paths, the assembly becomes cumbersome.

According to Published Unexamined Japanese Patent Application No. 62-70686 and Published Examined Japanese Patent Application No. 2-25037, all of the path and the valve unit or opening/closing mechanism for opening/closing the path are provided within the thickness of the intermediate partitioning plate.

A intermediate partition plate is usually formed to have a minimum thickness needed for partitioning in order to promote weight reduction of the compressor.

A long lateral hole having a diameter smaller than the thickness of the thin intermediate partition plate must be formed by working to extend from the outer circumferential surface of the thin intermediate partition plate to its inner circumferential surface.

Even slight off-centering will cause the distal end of the hole to project from the side surface of the intermediate partition plate during working.

Even after accurate hole formation is performed, an operation for inserting a slider and a spring in the thin hole and assembling them is needed, resulting in a cumbersome operation.

The size of a necessary portion becomes very small, the variable-capability capacity becomes small, and a sufficient effect cannot be obtained.

SUMMARY OF THE INVENTION

The present invention has been made in view of the above situation, and has as its object to provide a rotary compressor having a plurality of cylinder chambers partitioned by an intermediate partition plate, in which the capability can be variably changed in accordance with the load, thereby maintaining a sufficient variable capacity, the intermediate partition plate is set to have a minimum necessary thickness, thereby promoting size and weight reduction of the compressor, the working necessary for the thin intermediate partition plate is simple and free from failure, the number of necessary components is minimum, the operating performances of the working and assembly can be improved, and the cost can be decreased.

In order to achieve the above object, according to the present invention, there is provided a rotary compressor having a plurality of cylinder chambers partitioned by an intermediate partition plate, comprising:

a plurality of cylinders in which cylinder chambers are formed inside inner circumferential surfaces thereof and which are provided to be adjacent to each other in an axial direction;

an intermediate partition plate, provided between one and the other of the cylinders, for partitioning the cylinder chambers from each other;

slider guide means which is formed in the intermediate partition plate at a position on an outer side than inner circumferential surfaces of the cylinders and in which cylinder abutting surfaces of the intermediate partition plate are open;

a slider housed to be reciprocated in the slider guide means;

means for guiding a gas of the cylinder chambers during compression to the slider guide means to apply pressures of the cylinder chambers to the slider; and means for applying a back pressure to the slider, and moving forward or backward the slider by a difference pressure between the back pressure and the pressures of the cylinder chambers applied to the slider, thereby shutting off the cylinder chambers from each other or causing the cylinder chambers to communicate with each other.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 8 show an embodiment of the present invention, in which

FIG. 1 is a longitudinal sectional view of a multi-cylinder type rotary compressor, FIG. 2 is a view showing a configuration of a refrigeration cycle circuit having the multi-cylinder type rotary compressor, FIG. 3 is an exploded perspective view of an intermediate partition plate and major components associated with it, FIG. 4 is a plan view of the intermediate partition plate.

FIG. 7 is an enlarged view showing part of FIG. 5B; and

FIG. 8 is an enlarged view showing part of FIG. 6B; and

FIGS. 9 and 10 show another embodiment of the present invention, in which FIG. 10 is a longitudinal sectional view of the main part of the rotary compressor.

DETAILED DESCRIPTION OF THE PREFERRED EMBODIMENTS

Preferred embodiments of the present invention will be described with reference to the accompanying drawings.

Figure 1:
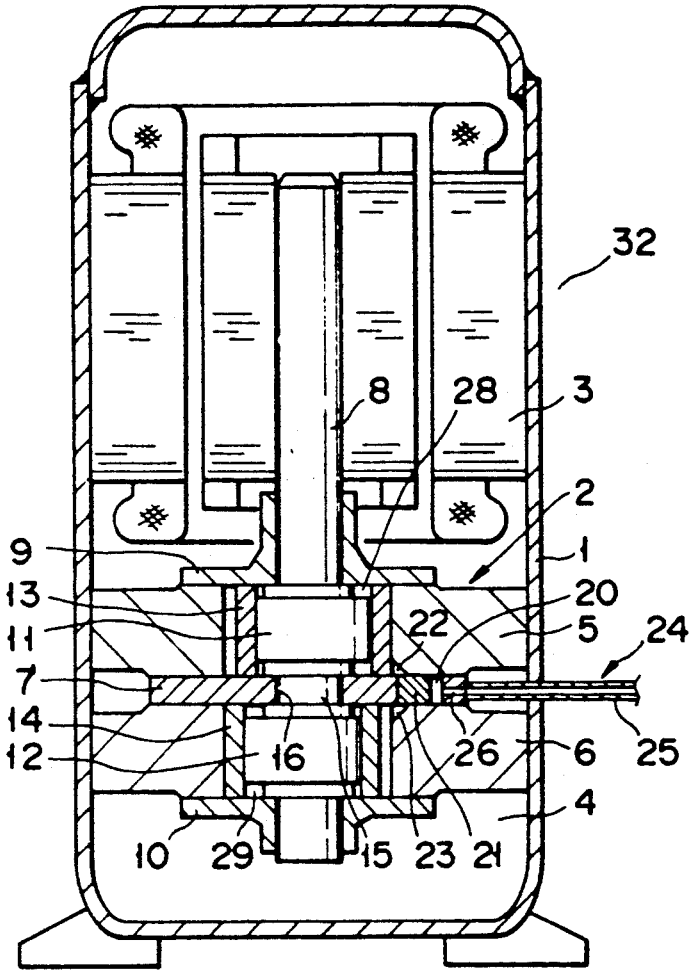

FIG. 1 shows a multi-cylinder type (two-cylinder type in this embodiment) rotary compressor 32.

An electric compressor body 2 is housed in a sealed case 1.

The electric compressor body 2 comprises a motor unit 3 and a compressor unit 4 coupled to each other by a rotating shaft 8 whose axis is directed in the vertical direction.

The motor unit 3 and the compressor unit 4 are provided on the upper and lower sides, respectively, of the rotating shaft 8.

The compressor unit 4 is fitted in the sealed case 1 and has first and second upper and lower cylinders 5 and 6.

An intermediate partition plate 7 is provided between the cylinders 5 and 6.

The rotating shaft 8 is axially rotatably supported by a main bearing 9 provided on the upper surface of the first cylinder 5 and a sub bearing 10 provided on the lower surface of the second cylinder 6.

A shaft portion 15 coaxial with a portion of the rotating shaft 8 pivotally supported by the main and sub bearings 9 and 10 is provided between eccentric portions 11 and 12 of the rotating shaft 8.

The shaft portion 15 is pivotally supported by a pivotal support hole 16 formed in the intermediate partition plate 7.

A space defined by the first cylinder 5, the main bearing 9, and the intermediate partition plate 7 is defined as a first cylinder chamber 28.

A space defined by the second cylinder 6, the sub bearing 10, and the intermediate partition plate 7 is defined as a second cylinder chamber 29.

The eccentric portions 11 and 12 phase-shifted from each other by 180x are provided in portions of the rotating shaft 8 housed in the first and second cylinder chambers 28 and 29.

First and second rollers 13 and 14 are fitted on the eccentric portions 11 and 12, respectively.

When the rotating shaft 8 is rotated, the first and second rollers 13 and 14 are eccentrically rotated in the cylinder chambers 28 and 29.

At this time, the circumferential surfaces of the rollers 13 and 14 always partially contact the inner circumferential surfaces of the cylinders 5 and 6, and a crescent-shaped space, when seen from the above, is formed in each of the cylinder chambers 28 and 29.

A vane elastically (not shown) urged by a spring (not shown) abuts against the rollers 13 and 14, dividing each of the respective crescent-shaped spaces into two chambers.

A suction and discharge valve mechanism (not shown) is provided to each of the cylinder chambers 28 and 29.

The positions of the suction and discharge valve mechanisms are set such that each of the chambers partitioned by the corresponding vane forms high- and low-pressure chambers along with the eccentric rotation of the rollers 13 and 14.

A guide opening portion 20 serving as a slider guide means is formed in the intermediate partition plate 7, and a slider 21 is housed to be reciprocated in the guide opening portion 20.

First and second notches 22 and 23 serving as first and second communicating paths are formed in inner circumferential surfaces of the first and second cylinders 5 and 6, respectively, at positions opposing the guide opening portion 20.

The first and second notches 22 and 23 are opened and closed depending on the position of the slider 21.

A back pressure pipe 25 constituting a back pressure applying means 24 is connected to the outer circumferential surface of the intermediate partition plate 7 through the sealed case 1.

The back pressure pipe 25 communicates with a through hole 26 formed to extend from the outer circumferential surface of the intermediate partition plate 7 to the end face of the guide opening portion 20.

The intermediate partition plate 7 and a constitution associated with it will be described.

Figure 3:
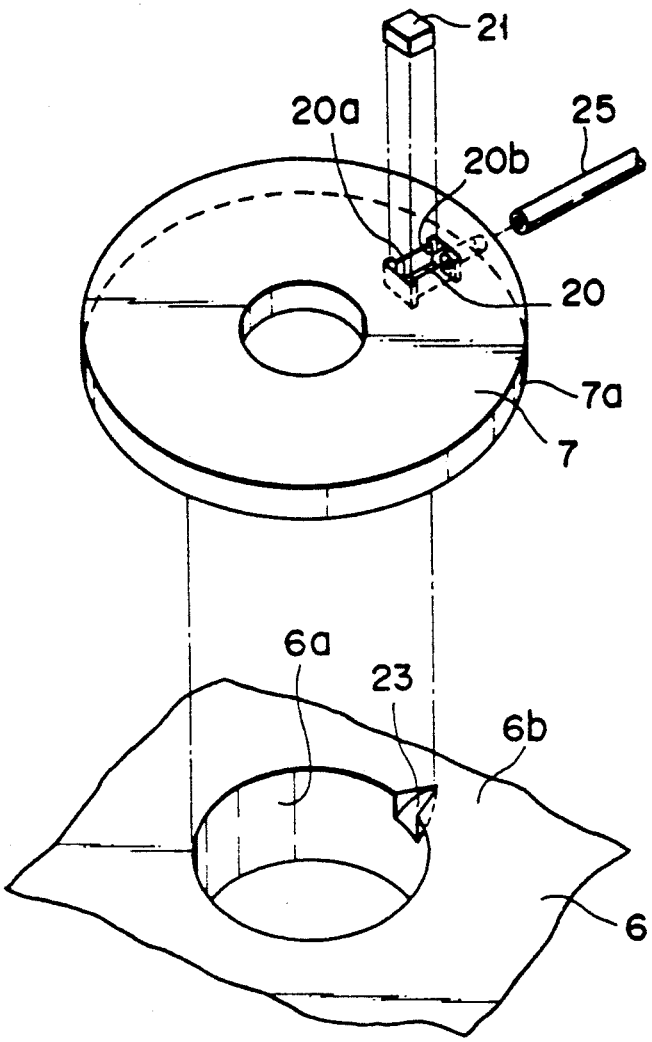
Figure 4:
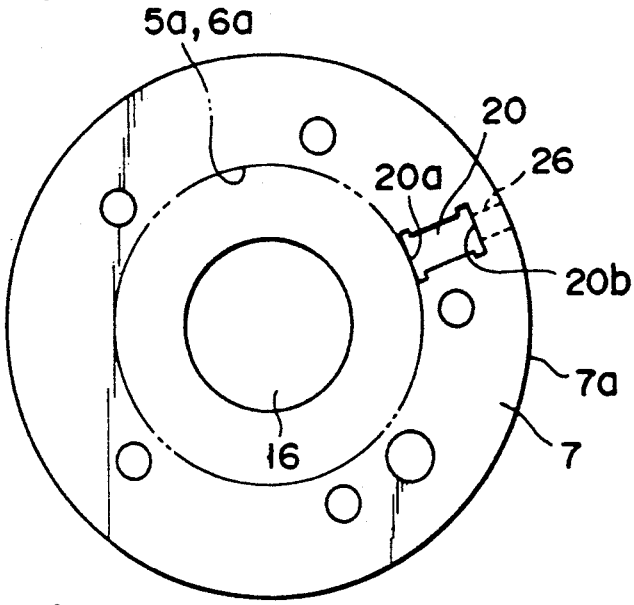

As shown in FIGS. 3 and 4, the intermediate partition plate 7 is a thin disk-shaped member.

The guide opening portion 20 is formed in the intermediate partition plate 7 at a circumferential end side. The upper and lower faces of the guide opening portion 20 are rectangular open surfaces formed to extend through the thickness of the intermediate partition plate 7.

The longitudinal direction of the guide opening portion 20 is directed to the center of the intermediate partition plate 7.

The position of an inner end face 20*a* of the guide opening portion 20 is set such that it is slightly outer than inner circumferential surfaces 5*a* and 6*a* (indicated by an alternate long and two short dashed line in FIG. 4) of the first and second cylinders 5 and 6.

The through hole 26 has a diameter falling within the range of the thickness of the intermediate partition plate 7, and is very short as it is located between an output circumferential surface 7*a* of the intermediate partition plate 7 and an outer end face 20*b* of the guide opening portion 20.

The slider 21 is housed in the guide opening portion 20 to be slidable in the longitudinal direction of the guide opening portion 20.

The thickness and width of the slider 21 are the same as the thickness and width of the guide opening portion 20, the thickness of the guide opening portion 20 being identical with the thickness of the intermediate partition plate 7.

FIG. 3 shows the second notch 23.

The second notch 23 is formed to have a triangular section defined by the inner circumferential surface 6*a* and a side surface 6*b*, which is abutted by the intermediate partition plate 7, of the cylinder 6.

The second notch 23 has a substantially parabolic form when seen from the above. The width of the notch 23 on the inner circumferential surface 6*a* side is set to be slightly smaller than the thickness of the intermediate partition plate 7.

The length of the second notch 23 in a direction extending from the inner circumferential surface 6*a* to the circumferential end side is set to be shorter than the size of the slider 21 in the longitudinal direction.

When the compressor unit 4 is assembled, the second notched portion 23 and the guide opening portion 20 oppose each other.

When the slider 21 abuts against the inner end face 20*a* of the guide opening portion 20, the open surface of the second notch 23 open to the side surface 6*b* of the cylinder 6 is completely closed by the slider 21.

When the slider 21 abuts against the outer end face 20*b* of the guide opening portion 20, the open surface of the second notch 23 open to the side surface 6*b* of the cylinder 6 is completely opened.

Although not shown in FIG. 3, the first notch 22 has the same shape as the second notch 23 and is formed at a position to oppose the second notch 23.

Figure 2:
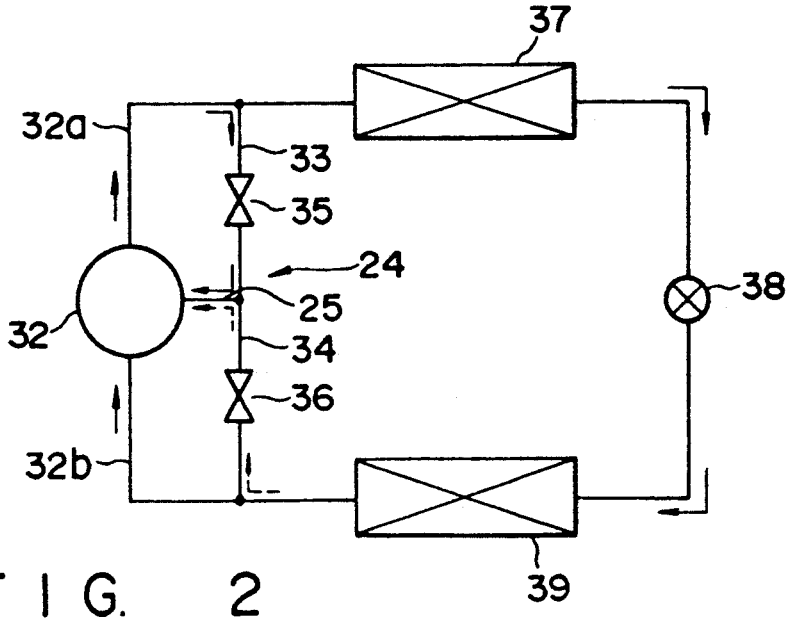

FIG. 2 shows a refrigeration cycle circuit of the refrigerating apparatus.

The discharge pipe 32*a* connected to the rotary compressor 32 is connected to a condenser 37, an expansion valve 38, and an evaporator 39. The evaporator 39 communicates with the suction side of the rotary compressor 32 through the suction pipe 32*b*.

The distal end portion of the back pressure pipe 25 connected to the rotary compressor 32 is connected to a high-pressure-side bypass pipe 33 communicating with an intermediate portion of a discharge pipe 32*a*.

The connecting portion of the back pressure pipe 25 and the high-pressure-side bypass pipe 33 is connected to a low-pressure-side bypass pipe 34 communicating with an intermediate portion of a suction pipe 32*b*.

A first opening/closing valve 35 is provided the high-pressure-side bypass pipe 33.

A second opening/closing valve 36 is provided the low-pressure-side bypass pipe 34.

A high- or low-pressure-side pressure can be guided to the back pressure pipe 25 by switching the first and second opening/closing valves 35 and 36 in an opposite manner.

The back pressure pipe 25, the high- and low-pressure-side bypass pipes 33 and 34, and the first and second opening/closing valves 35 and 36 constitute the back pressure applying means 24.

The operation of the rotary compressor 32 arranged in this refrigerating apparatus will be described.

When the rotary compressor 32 is driven, the refrigerant gas is compressed and heated by the compressor 32, is guided to the condenser 37 through the discharge pipe 32*a*, and is condensed into liquefied refrigerant.

The liquefied refrigerant is pressure-reduced as it passes through the expansion valve 38, and is guided to the evaporator 39 to be evaporated.

During evaporation, the surrounding evaporation latent heat is deprived of to perform refrigeration.

The evaporated refrigerant is drawn by vacuum into the rotary compressor 32 through the suction pipe 32*b*, is compressed again, and circulates in the manner as described above.

In the rotary compressor 32, the motor unit 3 rotates the rotating shaft 8.

As the rotating shaft 8 is rotated, the first and second rollers 13 and 14 are eccentrically rotated in the first and second cylinder chambers 28 and 29, respectively.

When the rollers 13 and 14 are rotated, the refrigerant gas is drawn by vacuum into the respective cylinder chambers 28 and 29, is compressed to a predetermined pressure, and is discharged.

To perform an operation with a large refrigeration capability requiring a full load, the first and second opening/closing valves 35 and 36 are opened and closed, respectively.

The high-pressure refrigerant gas discharged from the rotary compressor 32 to the discharge pipe 32*a* is guided to the condenser 37 and partially flows into the high-pressure-side bypass pipe 33.

The high-pressure refrigerant gas guided to the high-pressure-side bypass pipe 33 passes through the first opening/closing valve 35 and is entirely guided to the back pressure pipe 25 since the second opening/closing valve 36 is closed.

The refrigerant gas is then guided into the guide opening portion 20 through the through hole 26 to apply a high-pressure back pressure to the slider 21.

At the same time, the pressures of the first and second cylinder chambers 28 and 29 also act on the slider 21 through the first and second notches 22 and 23. However, since these pressures are being further compressed, they are lower than the back pressure described above.

The slider 21 is slid toward the inner end face 20*a* of the guide opening portion 20 by these difference pressures.

Figure 5A:
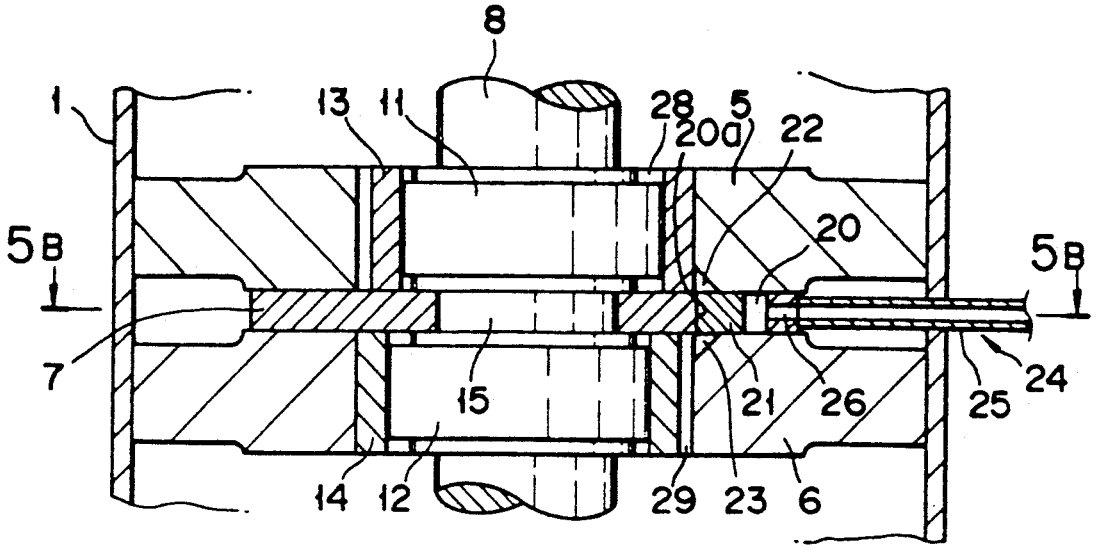
FIG. 5A is a longitudinal sectional view of the main part of the rotary compressor.
Figure 5B:
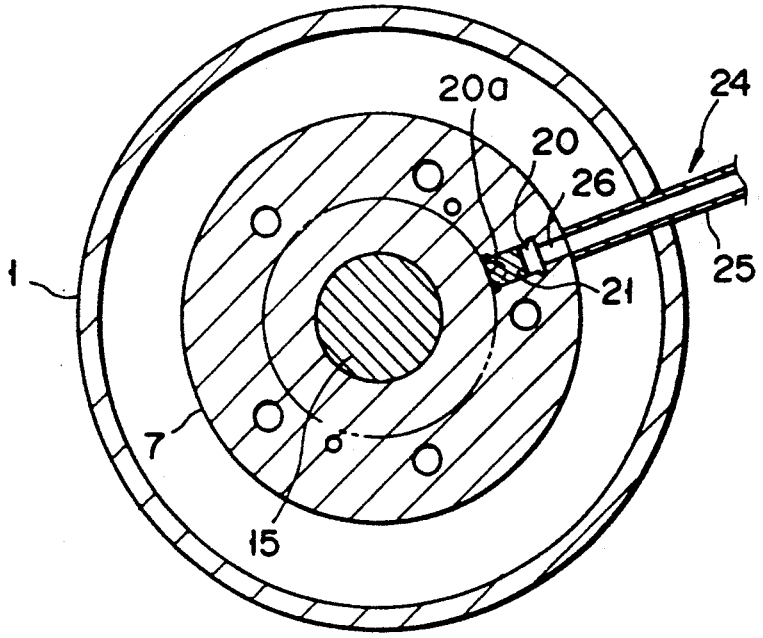
FIG. 5B is a cross-sectional plan view taken along the line B—B of FIG. 5A.
Figure 7:
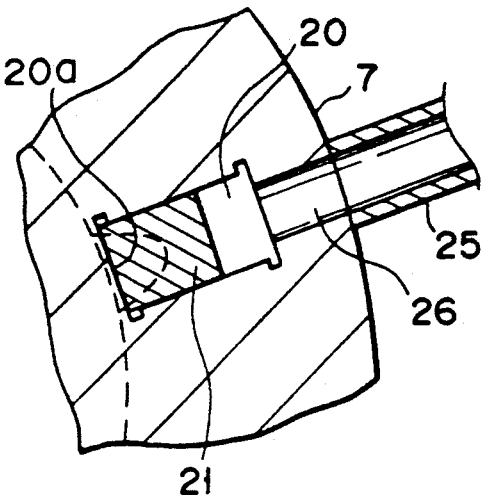

As shown in FIGS. 5A and 5B, and FIG. 7, the slider 21 is brought into tight contact with the inner end face 20*a* of the guide opening portion 20.

The slider 21 projects between the first and second notches 22 and 23 to close their open surfaces facing the guide opening portion 20.

The first and second notches 22 and 23 are shut off from each other by the slider 21.

The first and second cylinder chambers 28 and 29 are completely separated from each other and set in an independent state.

As a result, a full-load operation having a large refrigerating capability is performed.

When the load is decreased, an operation with a decreased refrigerating capability is performed.

The first and second opening/closing valves 35 and 36 are closed and opened, respectively.

Most of the low-pressure refrigerant gas evaporated by the evaporator 39 is guided to the rotary compressor 32 through the suction pipe 32*b*.

The low-pressure refrigerant gas partially passes through the second opening/closing valve 36 through the low-pressure-side bypass pipe 34, as indicated by broken arrows in FIG. 2.

Since the first opening/closing valve 35 is kept closed, the low-pressure refrigerant gas is guided to the back pressure pipe 25.

The low-pressure refrigerant gas is then guided to the guide opening portion 20 through the through hole 26 to apply a low-pressure back pressure to the slider 21.

At the same time, the pressures from the first and second cylinder chambers 28 and 29 act on the slider 21 through the first and second notches 22 and 23.

The back pressure acting on the slider 21 is lower than the pressures of the first and second cylinder chambers 28 and 29.

The slider 21 is slid toward the outer end face 20*b* of the guide opening portion 20 by these difference pressures.

Figure 6A:
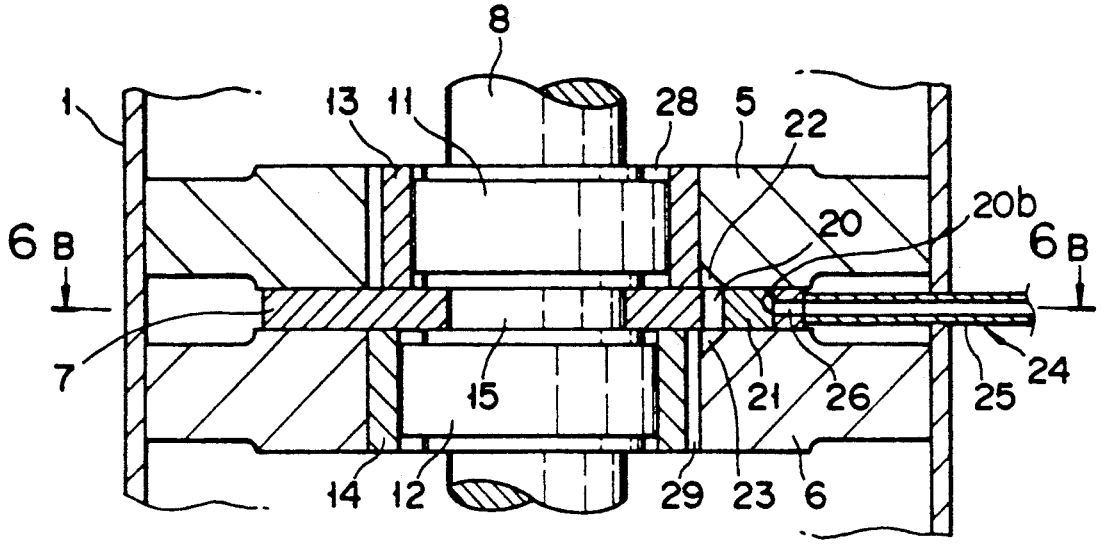
FIG. 6A is a longitudinal sectional view of the main part of the rotary compressor in a state different from that of FIG. 5A.
Figure 6B:
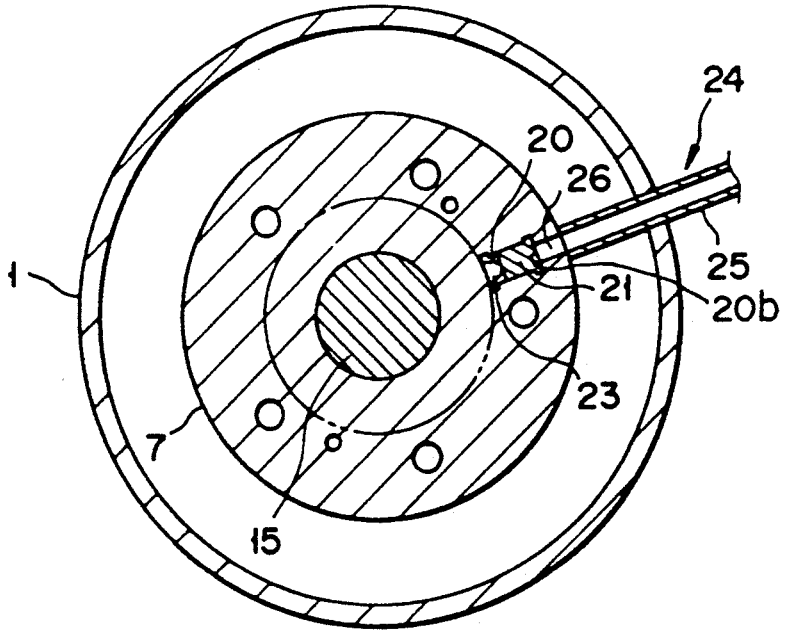
FIG. 6B is a cross-sectional plan view taken along the line B—B of FIG. 6A.
Figure 8:
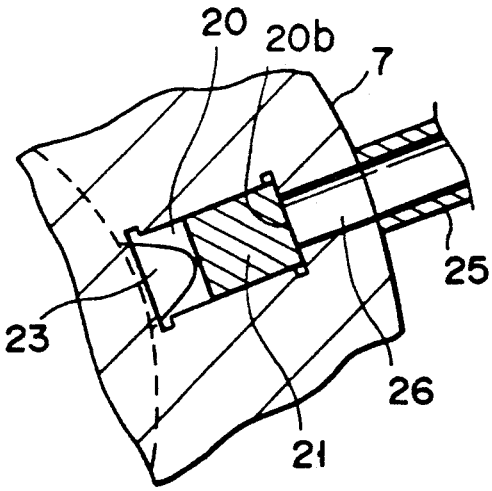

As shown in FIGS. 6A and 6B, and FIG. 8, the slider 21 is brought into tight contact with the outer end face 20*b* of the guide opening portion 20.

The open surfaces of the first and second notches 22 and 23 facing the guide opening portion 20 are completely opened.

The first and second cylinder chambers 28 and 29 are caused to communicate with each other through the first and second notches 22 and 23, and the guide opening portion 20.

As the eccentric portions 11 and 12 of the rotating shaft 8 are phase-shifted from each other by 180°, a pressure difference occurs constantly between the first and second cylinder chambers 28 and 29.

The pressures of the first and second cylinder chambers 28 and 29 change in accordance with the rotating angle of the rotating shaft 8.

In a compression stroke in which the pressure of the first cylinder chamber 28 is higher than that of the second cylinder chamber 29, the refrigerant gas in the first cylinder chamber 28 is guided to the second cylinder chamber 29, and the capability of the first cylinder chamber 28 is decreased.

In a compression stroke in which the pressure of the second cylinder chamber 29 is higher than that of the first cylinder chamber 28, the refrigerant gas in the second cylinder chamber 29 is guided to the first cylinder chamber 28, and the capability of the second cylinder chamber 29 is decreased.

That is, the refrigerating capability of the rotary compressor 32 as a whole is decreased.

In this manner, capability control in accordance with a variation in load can be performed.

Since the guide opening portion 20 is open to both the upper and lower side surfaces of the intermediate partition plate 7, a capacity of the guide opening portion 20, i.e., a sufficient capacity necessary for changing the capability can be maintained.

Since the guide opening portion 20 is open to both the surfaces of the intermediate partition plate 7 to extend through the thickness of the intermediate partition plate 7, the thinner the intermediate partition plate 7, the easier the working.

Since the first and second notches 22 and 23 have a triangular section, they can be formed by simple working.

Only a single slider 21 need be housed in the guide opening portion 20, and any other components such as a spring are not needed, resulting in a simple structure.

The slider 21 needs only a simple shape for opening and closing the first and second notches 22 and 23, resulting in a simple manufacturing process.

Although the through hole 26 has the small diameter falling within the range of the thickness of the intermediate partition plate 7, as it is very short, it can be accurately formed by easy lateral hole working free from off-centering.

If a gasket is interposed between each of the cylinders 5 and 6 and the intermediate partition plate 7, the through hole can be changed to one having a larger diameter and extending between the two side surfaces of the intermediate partition plate 7.

In this case, the diameter of the through hole must be smaller than the width of the guide opening portion 20 because the slider 21 must be housed in the guide opening portion 20.

Since the back pressure applying means 24 directly uses the high- and low-pressure refrigerant gases discharged from the discharge and suction pipes 32*a* and 32*b*, respectively, of the rotary compressor 32, the structure can be simple.

Figure 9A:
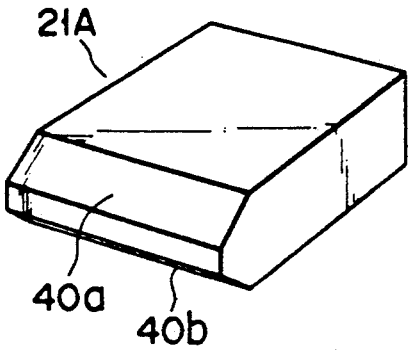
FIG. 9A is a perspective view of a slider.

The slider can be a slider 21A shown in FIG. 9A.

One end portion of the slider 21A forms inclined surfaces 40*a* and 40*b* obtained by obliquely working the upper and lower portions of the slider 21A.

Since the pressures of cylinder chambers 28 and 29 guided through the first and second notches 22 and 23 easily act on the inclined surfaces 40*a* and 40*b*, a quick-response slide operation is obtained.

Figure 9B:
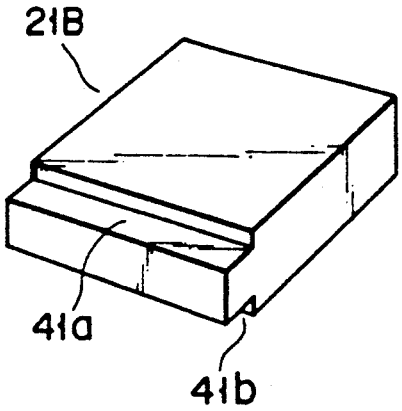
FIG. 9B is a perspective view of another slider.

The slider can be a slider 21B shown in FIG. 9B.

One end portion of the slider 21B forms stepped portions 41*a* and 41*b* obtained by working the upper and lower portions of the slider 21B in an stepped manner.

Since the pressures of cylinder chambers 28 and 29 guided through the first and second notches 22 and 23 easily act on the stepped portions 40*a* and 40*b*, a quick-response slide operation is obtained.

Figure 10:
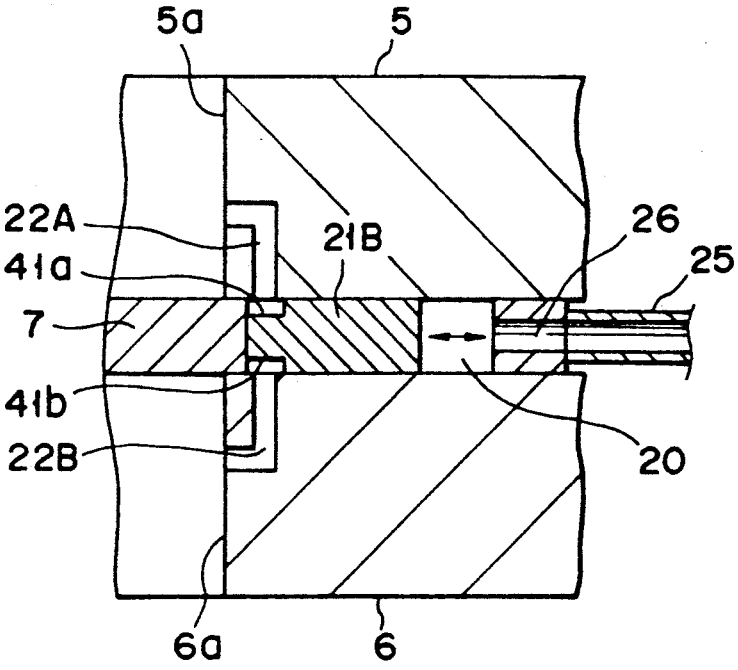

According to the invention, the communicating paths are not limited to those 22 and 23 shown in FIG. 1. They can be those 22A and 22B shown in FIG. 10.

The communicating paths 22A and 22B are thin holes communicating between inner circumferential surfaces 5*a* and 6*a*, respectively, and a guide opening portion 20.

A slider 21B used in this embodiment has stepped portions 41*a* and 41*b* identical to those shown in FIG. 9B.

The slider 21A having the inclined surfaces 40*a* and 40*b*, as shown in FIG. 9A, may be combined with the communicating paths 22A and 22B.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A rotary compressor having a plurality of cylinder chambers partitioned by an intermediate partition plate, comprising:

a plurality of cylinders in which cylinder chambers are formed and which are adjacent to each other in an axial direction of said cylinders;

an intermediate partition plate, provided between one and the other of said cylinders, for partitioning said cylinder chambers from each other;

slider guide means which is formed in that portion of said intermediate partition plate which is outside of the inner circumferential surfaces of said cylinders;

a slider housed to be reciprocated in said slider guide means;

means for guiding a gas of said cylinder chambers during compression to said slider guide means to apply pressures of said cylinder chambers to said slider; and means for applying a back pressure to said slider, and moving forward or backward said slider by a difference pressure between the back pressure and the pressures of said cylinder chambers applied to said slider, thereby shutting off said cylinder chambers from each other or causing said cylinder chambers to communicate with each other.

2. A machine according to claim 1, wherein said slider guide means is formed in said intermediate partition plate and extends through said intermediate plate.

3. A machine according to claim 2, wherein said slider guide means is rectangular, and said slider is rectangular shape.

4. A machine according to claim 1, wherein said means for guiding a gas of said cylinder chambers during compression to said slider guide means to apply the pressures of said cylinder chambers to said slider comprises first and second communicating paths, which are connected, at one end, to said cylinder chambers, respectively, and which oppose, at the other end, said slider guide means.

5. A rotary compressor having a plurality of cylinder chambers partitioned by an intermediate partition plate, comprising:

a plurality of cylinders in which cylinder chambers are formed and which are adjacent to each other in an axial direction of said cylinders;

an intermediate partition plate, provided between one and the other of said cylinders, for partitioning said cylinder chambers from each other;

slider guide means formed in that portion of said intermediate partition plate which is outside the inner circumferential surfaces of said cylinders, and extending through said intermediate partition plate;

a slider housed to be reciprocated in said slider guide means;

first and second communicating paths, respectively formed in said cylinders, and each having one end open to corresponding one of said cylinder chambers and the other end opened to oppose said slider guide means, for guiding gas from said cylinder chambers during compression to said slide guide means in order to apply pressure in said cylinder chambers to said slider; and means for applying a back pressure to said slider, moving forward or backward said slider by a difference pressure between the back pressure and the pressures of said cylinder chambers applied to said slider, in order to close the other open end of each of said communicating paths by said slider, thereby shutting off said cylinder chambers from each other, or in order to open said communicating paths, thereby causing said cylinder chambers to communicate with each other through said communicating paths and said slider guide means.

6. A machine according to claim 5, wherein said communicating paths comprise first and second notches each formed by cutting a portion of a corner defined by the inner circumferential surface of said cylinder and that end face of the cylinder, which abuts against said intermediate partition plate.

7. A machine according to claim 5, wherein said communicating paths are thin holes formed in said cylinders, respectively, each opening, at one end, to the inner circumferential surface of the cylinder chamber and, at the other end, to said intermediate partition plate.

8. A machine according to claim 5, wherein said slider has an end portion formed as an inclined surface, said end portion of said slider being on a side of said slider on which the pressures of said cylinder chambers act through said first and second communicating paths.

9. A machine according to claim 5, wherein said slider has an end portion formed as a step shape, said end portion of said slider being on a side of said slider on which the pressures of said cylinder chambers act through said first and second communicating paths.

10. A machine according to claim 1, wherein said rotary compressor is provided in a refrigeration cycle circuit of a refrigerating apparatus.

11. A machine according to claim 10, wherein said means for applying the back pressure to said slider switches between high- and low-pressure-side pressures of said refrigeration cycle circuit and guides the selected pressure.

12. A machine according to claim 10, wherein said means for applying the back pressure to said slider comprises high and low-pressure-side bypass pipes, said high-pressure-side bypass pipe causing a discharge side pipe of said rotary compressor and said slider guide means to communicate with each other and having a first opening/closing valve, said low-pressure-side bypass pipe causing a suction side pipe of said rotary compressor and said slider guide means to communicate with each other and having a second opening/closing valve, and said means for applying the back pressure applies a high- or low-pressure-side pressure of said refrigeration cycle circuit to said slider by switching said first and second opening/closing valves alternately.

13. A rotary compressor having a plurality of cylinder chambers partitioned by an intermediate partition plate, comprising:

a plurality of cylinders in which cylinder chambers are formed and which are adjacent to each other in an axial direction of said cylinders;

an intermediate partition plate, provided between one and the other of said cylinders, for partitioning said cylinder chambers from each other;

slider guide means formed in that portion of said intermediate partition plate which is outside the inner circumferential surfaces of said cylinders, and extending through said intermediate partition plate;

a slider housed to be reciprocated in said slider guide portion;

first and second communicating paths, respectively formed in said cylinders, and each having one end open to corresponding one of said cylinder chambers and the other end opened to oppose said slider guide means, for guiding the gas from said cylinder chambers during compression to said slider guide means in order to apply pressure in said cylinder chambers to said slider; and back pressure applying means for switching between high- and low-pressure-side pressures of a refrigeration cycle circuit and guiding the selected pressure to said slider guide portion, applying a back pressure to said slider to cause said slider to move forward or backward by a difference pressure between the back pressure and pressures of said cylinder chambers applied to said slider through said communicating paths, in order to close the other open end of each of said communicating paths by said slider, thereby shutting off said cylinder chambers from each other, or in order to open said communicating paths, thereby causing said cylinder chambers to communicate with each other through said communicating paths and said slider guide portion.

14. A rotary compressor having a plurality of cylinder chambers partitioned by an intermediate partition plate, comprising:

a plurality of cylinders in which cylinder chambers are formed and which are adjacent to each other in an axial direction of said cylinders;

an intermediate partition plate, provided between one and the other of said cylinders, for partitioning said cylinder chambers from each other;

slider guide means formed in that portion of said intermediate partition plate which is outside the inner circumferential surfaces of said cylinders, and extending through said intermediate partition plate;

a slider housed to be reciprocated in said slider guide means;

first and second communicating paths, respectively formed in said cylinders, and each having one end open to corresponding one of said cylinder chambers and the other end open to oppose said slider guide means, for guiding the gas from said cylinder chambers during compression to said slider guide mean in order to apply pressure in said cylinder chambers to said slider;

high-pressure-side bypass means, for connecting said slider guide portion to a high-pressure side of a refrigeration cycle circuit in order to increase refrigeration capability, so that a refrigerant gas is supplied from the high-pressure side of said slider guide portion to said slider due to a back pressure higher than the pressures on said cylinder chambers applied to said slider through said communicating paths, thereby moving said slider and, hence, closing the other end opening of each of said communicating paths, whereby the refrigerant gas is compressed in said cylinder chambers independently; and low-pressure-side bypass means, for connecting said slider guide portion to a low-pressure side of the refrigeration cycle circuit in order to decrease refrigeration capability, so that a refrigerant gas is supplied from the low-pressure side of said slider guide portion to said slider due to a back pressure lower than the pressures in said cylinder chambers applied to said slider through said communicating paths, thereby moving said slider from the other end opening of each of said communicating paths and, hence, connecting said cylinder chambers by means of said communicating paths and said slider guide portion, whereby a refrigerant gas is supplied from one of said cylinder chambers, wherein the gas is being compressed, to the other cylinder chamber, thereby to decrease a compression capacity.

* * * * *